United States Patent [19]

Blackman

[11] 4,043,560

[45] Aug. 23, 1977

[54] BOARD GAME EMPLOYING PLAYING TILES AND COLOR CODED DICE

[76] Inventor: Irving L. Blackman, 180 N. La Salle St., Chicago, Ill. 60601

[21] Appl. No.: 732,167

[22] Filed: Oct. 13, 1976

[51] Int. Cl.[2] ..... A63F 3/00

[52] U.S. Cl. ..... 273/135 AC; 273/135 AA; 273/137 D

[58] Field of Search ..... 273/134 D, 135 R, 135 AB, 273/135 AA, 137 R, 137 B, 137 C, 135 AC, 136 D

[56] References Cited

U.S. PATENT DOCUMENTS

| | | | |
|---|---|---|---|
| 825,809 | 7/1906 | Connell | 273/137 C |
| 3,267,590 | 8/1966 | Browning | 273/135 R |
| 3,549,150 | 12/1970 | Weeks | 273/135 B |
| 3,948,525 | 4/1976 | Faintuch et al. | 273/135 AA |

FOREIGN PATENT DOCUMENTS

| | | | |
|---|---|---|---|
| 163,103 | 11/1920 | United Kingdom | 273/137 C |

*Primary Examiner*—Anton O. Oechsle
*Assistant Examiner*—Arthur S. Rose

[57] ABSTRACT

A board game includes a game board upon which there is provided a series of areas having indicia keyable to identical indicia on a set of playing tiles. Additional areas on the board are designated for the positioning therein of pre-valued coin-like elements. The board is also given a designated starting area having indicia keyable with like indicia carried by selected ones of the playing tiles. A set of playing tiles is subdivided into a series of sub-sets equal in number to the number of areas in the aforementioned series of areas on the game board. Each such sub-set includes a plurality of playing tiles provided with indicia which is identical to the indicia in a different one of the areas of the series of areas on the game board. A set of three dice is provided. One of the dice carries non-numerical indicia on each of its faces. A second of the dice carries a different even-numbered numeral on each of its faces. The third of the dice carries a different odd-numbered numeral on each of its faces. The second and third dice are color coded each in a different color, and the unnumbered dice has at least two faces color coded to the correspond with the colors on respective ones of the numbered dice. The game further includes a set of coin-like elements having point values assigned to each and at least two playing tiles carrying indicia thereon identical to the indicia on the starting area of the game board.

8 Claims, 6 Drawing Figures

BOARD GAME EMPLOYING PLAYING TILES AND COLOR CODED DICE

BACKGROUND OF THE INVENTION

The present invention relates to board games of the type in which playing tiles are manipulated so as to be combinable with other tiles on a game board to thereby accumulate point totals in accordance with a set of game rules.

There are many board games available in which playing tiles are used in conjunction with a game board to form words having point totals. There are other games in which the playing tiles are arranged on the game board to form patterns other than words in the accumulation of point scores. U.S. Pat. No. 3,863,929 issued Feb. 4, 1975 to Steven J. Kahan, for example, utilizes tiles which are provided with colored areas and value numbers. The arrangement of the tiles so as to form continuous colored rings and isosceles triangles leads to point accumulation.

SUMMARY OF THE INVENTION

It is one object of the invention to provide a board game which is interesting and combines the elements of skill and chance in its playing.

It is another object of the invention to provide a board game where the contestants may employ various strategies and where such strategies may be varied game to game because of the variance of certain game parameters game to game.

It is a further object of the invention to provide a board game which employs playing tiles and dice in a unique manner.

Other objects and advantages of the invention will become readily apparent from the following description of the invention.

According to the present invention there is provided a board game comprising in combination: a game board having a series of areas provided with indicia therein keyable with identical indicia provided on a set of playing tiles, additional areas designated for the positioning therein of pre-valued elements, and a designated starting area having indicia therein keyable with like indicia carried by selected ones of the playing tiles; a set of playing tiles subdivided into a series of sub-sets equal in number to the number of areas in the series of areas on the game board, each of the sub-sets comprising a plurality of playing tiles provided with identical indicia thereon, the indicia on the tiles of the respective sub-sets being identical to the indicia in a different one of the areas of the series of areas of the game board; a set of three dice, a first of the dice carrying non-numerical indicia on each of the faces thereof, a second of the dice carrying a different even-numbered numeral on each of the faces thereof, and the third of the dice carrying a different odd-numbered numeral on each of the faces thereof, the second and third dice each being color coded a different color, and the first dice having at least one of the faces thereof color coded to correspond with the color on a different one of the second and third dice; a set of pre-valued elements; and at least two playing tiles carrying indicia thereon identical to the indicia carried by the starting area of the game board.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
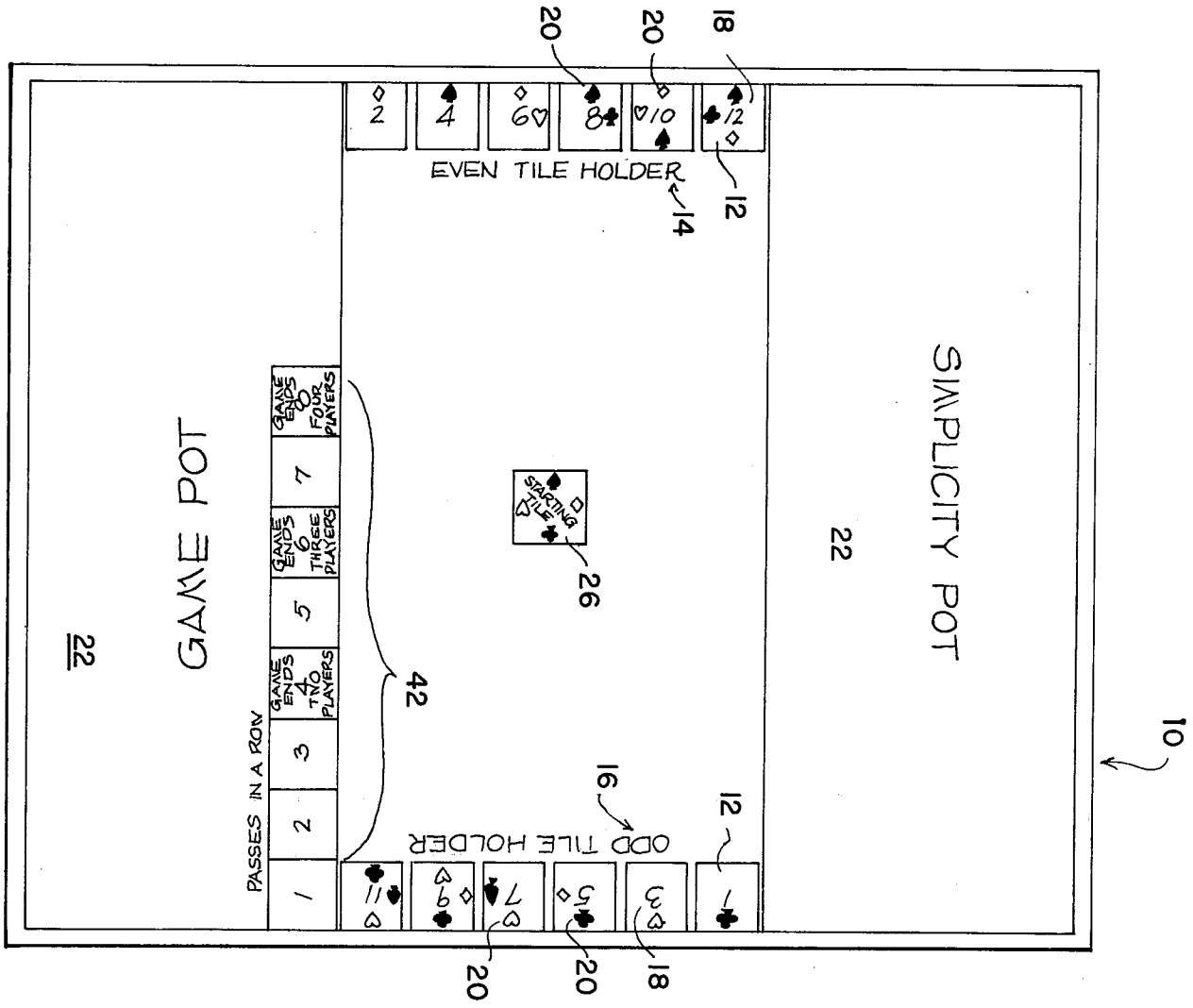
FIG. 1 is a top plan view of the game board of the invention.

Referring to the drawings there is shown a game board 10 which may be constructed of any suitable material. Cardboard may be utilized if desired or a material offering still greater rigidity.

The board is provided with a series of areas 12, which, as shown in FIG. 1, may be arranged in two groups 14, 16 located along opposed sides of the board. In the presently preferred embodiment of the invention, the series comprises 12 spaces each having a different numerical integer 18 therein ranging consecutively from one to 12. In addition, each of such areas is given one or more of the standard four symbols 20 carried by the cards of a deck of playing cards, i.e., clubs, diamonds, hearts and spades.

At each end of the game board there is provided an area 22 designated for the positioning of prevalued elements therein. Coin-like elements 24 are desirably utilized as such pre-valued elements, and such coin-like elements are each provided on one or both faces with an indication of the point value assigned thereto. One of the areas 22 is designated GAME POT and the other of such end areas is given the designation SIMPLICITY POT.

The game board is also provided with a space 26 designated as the starting area. This space, as can be seen from FIG. 1, is desirably positioned in the center of the game board. The starting space or area 26 is given no numerical indicia but rather is provided along each of its sides with one of the symbols carried by the cards of a deck of playing cards. Thus one of the sides is given the symbol of clubs, one of hearts, one of diamonds and one of spades. From the rules of the game, to be set forth hereinafter, it will be seen that the playing tiles of the several players can be added to the starting area by matching of the symbols of the player's tile with the like symbol of the starting area.

Figure 5:
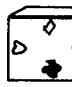
FIG. 5 is a perspective view of one of the personal starting tiles.
Figure 2:
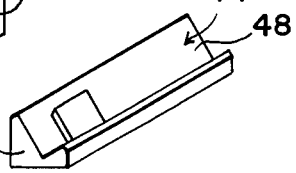
FIG. 2 is a perspective view of one of the tile-holding members.
Figure 4:
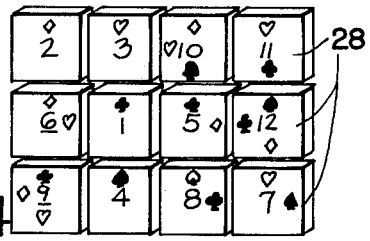
FIG. 4 is a perspective view of a collection of playing tiles of which one has been selected from each sub-set.

The game includes a set of playing tiles 28 which are subdivided into a series of sub-sets which are equal in number to the number of areas 12 on the game board. Desirably there are a total of 72 playing tiles, one game board starting tile and four personal starting tiles 30 as shown in FIG. 5. Each sub-set of playing tiles thus preferably comprises six tiles. All of the playing tiles in each of the sub-sets is identically marked. In FIG. 4 there is depicted a collection of playing tiles which includes one tile from each sub-set. It will thus be observed that there is a sub-set of playing tiles having markings which are identical to respective ones of the individual areas comprising the series 12.

Figure 3:
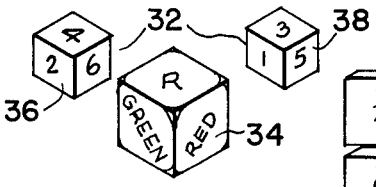
FIG. 3 is a perspective view of the set of dice employed in the invention.
Figure 6:
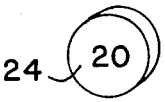
FIG. 6 is a perspective view of one of the coin-like pre-valued elements.

The game also includes a set of three dice 32 as shown in FIG. 3. A first of the dice 34 carries no numerical indicia thereon but desirably is color coded on four of its end faces. Thus, one pair of opposed end faces is colored one color and a second pair of end faces is given a different color. As will be described shortly, the two colors selected should be the colors of the second and third dice of the set. The purpose for color coding the first dice to correspond with the colors of the other two dice will become clear from the rules of the game. The remaining two end faces of the first unnumbered dice are each driven a representative symbol such as the letters R and O from the alphabet. These latter end faces and the color coded end faces serve to impart to the first dice the function of a control dice and dictates, in conjunction with the color and indicia on the other two dice, the play of the game. The second dice 36 in the set is color coded to correspond with one of the colors employed on the first dice and each of its faces are provided with a different even numbered numeral. Preferably the numerals comprise integers which run consecutively from two to twelve. The third dice 38 is color coded to correspond with the remaining color employed on die 32. Each of the end faces on die 38 is given an odd-numbered numeral preferably comprising integers which run consecutively from one to eleven. In the preferred embodiment of the invention, one of the numbered dice is colored red and the other numbered die is colored green.

The game further includes a set of pre-valued elements which may conveniently be formed as coins 24. Each of such coins is assigned a point value which appears upon one or both of its face.

For convenience the game board is provided with a series of eight adjacently arranged spaces 42 which are consecutively numbered from one to eight. As can be seen from FIG. 1, certain of the spaces are provided with indicia which specifies one manner by which the game may be terminated. Resort to the rules of the game will clarify such manner for ending the game.

A plurality of elongated tile-holder members 44 is included in the game apparatus. The tile-holder members are constructed so as to have a base 46 which rests upon a support surface such as the game board or upon a table and an upstanding face 48 against which a plurality of playing tiles may recline in side-by-side relation so that the indicia on all of such playing tiles may be simultaneously displayed.

The game is desirably played by observing the following suggested rules. It will be understood, of course, that the rules of the game may be varied to suit the tastes of the players. However, the functional relationship between the game board and the playing tiles should be preserved in order to maintain the optimum versatility and challenge of the game and its capability of sustaining the interest of the players.

RULES OF THE GAME

The game of SIMPLICITY is designed for two, three or four players and involves a combination of skill, strategy and chance in the playing of the game.

OBJECT OF THE GAME

The object of the game is to cause all of the player's opponents to lose the points with which they begin the game. The last player to retain any of the original points wins.

SETTING UP TO COMMENCE THE GAME

Each player receives the following items:

1. a personal tile-holder
2. one starting tile
3. a supply of coins worth 500 points.

COMMENCING PLAY

1. Where two or three players are to participate two tiles of each sub-set are placed one each of the 12 designated areas of the game board FACE UP (a total of 24 tiles). If four players are to participate in the game, then three tiles of each sub-set are placed upon each of such areas (a total of 36 tiles).

2. The remaining playing tiles in the game apparatus are placed FACE DOWN in some convenient location after shuffling the tiles to assume a random distribution. Where only two players are competing one each of the tiles bearing numerals 1, 2, 3 and 4 are removed prior to placing the tiles FACE DOWN.

3. Each player draws seven tiles from the tiles which have been placed FACE DOWN and such tiles are positioned on the players' tile-holders so that they can be viewed by the player but not by the opponents. The undrawn FACE DOWN tiles are not used again until the next round of play.

4. Each player pays the perscribed number of points to the SIMPLICITY and Game pot areas.

SELECTING PLAYER FOR FIRST TURN

Each player rolls one of the numbered dice and notes the numeral face up. The player rolling the the highest number has thus drawn first turn. Play proceeds to the left or right as agreed upon by the players. On the next round the player immediately to the left (or right depending upon the sequence of turns agreed to amongst the players) of the original first roller has first turn. Turns are similarly decided upon for each subsequent round until the game ends.

The player who has been awarded first turn then declares, before the first turn roll of the dice, whether HIGH or LOW point total wins in the event the game ends on PASSING. This is important because it will have an influence upon the strategy of play.

HOW TO READ DICE

The three dice must always be rolled simultaneously by each player when it is their turn. Upon rolling the dice the control or key die (unnumbered die) is observed first.

1. If the control die shows RED face up the red die is next inspected to ascertain the numeral which is FACE UP. A playing tile is then taken from the one of the 12 areas on the game board upon which there are positioned the playing tiles having matching indicia. If there are not tiles having the numeral FACE UP on the red die, the player receives no tile and continues to complete the turn as described below under COMPLETING TURN.

2. If the control die shows GREEN face up then the green die is next inspected to determine the tile to be taken from one of the 12 areas on the game board. As described above in respect of the red die, if there are not tiles on the designated area no tile may be taken and the turn is completed as described below.

3. If the control die shows R face up (R representing ROLLER) the player selects any tile from any of the twelve areas on the game board. In the event that one or more of such areas are out of tiles the player may elect not to take any tile on that turn.

4. If the control die shows O face up (O representing opponent) the opponent to the immediate left of the player selects any tile from the game board and gives it to the roller. The opponent may elect not to take any tile for presentation to the roller. In such event, the roller does not receive a tile on that turn.

HOW TO EXERCISE A TURN

No player can skip a turn at any time during the playing of the game. The player may PASS, however, as described below.

1. First Part Of Turn

Upon rolling the three dice the player follows the above rules relative to selection of a tile from the game board or not taking a tile. However, even when no tile is taken the player must complete the turn as described below under COMPLETING TURN.

All tiles taken from the game board must be placed in front of the player's personal tile-holder FACE UP. These tiles remain in this position until the end of the round *or* until such tiles are played down.

2. Completing Turn

The player completes the turn by making any one or a combination of selected ones of the following plays:

a. COME DOWN
b. ADD TO MELDING
c. LAY-OFF BONUS
d. SIMPLICITY
e. GO OUT or
f. PASSING (Either because the player is unable to make a play or the player elects to PASS for some strategic reason).

PLAYING DOWN TILES

Playing tiles can only be played down by matching a symbol on the tile with a like symbol on one of the tiles which have previously been played down. Thus, one of the following matching combinations must be adopted:

1. Club to club
2. Diamond to diamond
3. Heart to heart
4. Spade to spade
5. Blank to blank providing the tile also matches the adjacent tile with (1), (2,), (3) or (4).

Note that most tiles can be played down legally in more than one way.

COME DOWN

A player can "come down" only once during any one round.

Only ODD numbered tiles can be used to come down. The tiles played down must total at least 26, but only that number of tiles necessary to total 26 can be played down. (Assume for example that tiles 7, 11 and 11 were played down for a total of 29. Even if the player had more odd numbered tiles he could not play any more of them down because he is already over the necessary 26 count. Of course, he could elect any other combination of odd numbered tiles to reach the necessary 26 count).

The tiles are played down on the player's OWN green starting tile. These tiles and any tiles subsequently added are called a player's "melding." This melding must be plainly visible to all other players.

If a player cannot come down or elects not to come down, he simply "passes" until his next turn.

A come down play can never end the round.

ADD TO MELDING

A player can "add to melding" only after has has come down. This play is accomplished by playing down TWO (NO MORE, NO LESS) tiles onto the player's OWN melding. Any tile a player holds, odd or even, may be used to add to melding.

An add to melding play only ends the round if it is a GO OUT.

LAY-OFF BONUS

After a player has completed an add to melding play, he can "lay-off" as a bonus ONE tile only on:

1. Another player's melding or
2. The game board melding (the first tile used to lay-off and any other tiles subsequently used to lay-off are called the game board's melding).

YOU CANNOT LAY-OFF:

1. When you come down
2. On another player's melding until he has come down.
3. Your last tile and go out.

YOU CAN LAY-OFF: only the following tiles:

ON ANOTHER PLAYER'S MELDING — Any even numbered tile.

ON THE GAME BOARD's MELDING — Any even numbered tile; tile 1 and tile 3.

A lay-off play can never end the round.

HINT— The lay-off play is used to (1) eliminate tiles from your own hand; (2) block SIMPLICITY on the game board; (3) block an opposing player from making the add to melding play.

SIMPLICITY

SIMPLICITY can be scored on EITHER:

1. A player's own green starting tile or
2. The game board's green starting tile.

All four tiles marked 1, 2, 3 and 4 must be played down at the SAME TIME.

A player cannot score SIMPLICITY on:

1. HIS OWN GREEN STARTING TILE — Unles some other player has come down first.
2. THE GAME BOARD'S GREEN STARTING TILE — Unless he has already come down on a prior turn.

NOTE: It is possible for one or more players to have the four tiles needed for SIMPLICITY and not be able to play them down due to the rules of play.

A SIMPLICITY play ends the round.

GO OUT

GO OUT is accomplished when a player plays down his last two tiles on an ADD TO MELDING play.

A player cannot go out by using a LAY OFF.

A player can only GO OUT when he started his turn with:

1. ONE tile and drew another tile from the game board; or
2. TWO tiles and failed or draw another tile from the game board.

A GO OUT play ends the round.

PASSING

PASSING ordinarily does not end a round. but — Any round ends instantly without any further play of any kind, whenever —

AFTER any player has come down and subsequently there are four PASSES in a row if there are two players (six PASSES for three players, eight PASSES for four players).

It is best to keep track of passes in the space provided on the game board. Use one of the coins in the game pot.

WHO WINS

That player who at the instant the round ended wins when he has the —

1. MOST points in his hand if the first player declared HIGH at the beginning of the round.
2. LEAST points in his hand if the first player declared LOW at the beginning of the round.

POINT PAYMENTS AND COLLECTIONS

1. TO BEGIN EACH ROUND — Each player pays 15 points to the SIMPLICITY POT; 5 points to the GAME POT.
2. OUT TILE — If roller's tile is out — whether by roll of the dice, his own or opponent's selection — 10 points to GAME POT.
3. COME DOWN — No payment, ADD TO MELDING — No payment
4. LAY-OFF
   a. ON ANOTHER PLAYERS's MELDING — The amount of points shown on the tile used to lay-off to the player on whose melding the tile is placed.
   b. ON THE GAME BOARD MELDING — Double the amount of points shown on the tile used to lay-off to the GAME POT.
5. SIMPLICITY
   WINNER COLLECTS:
   a. FROM EACH PLAYER — Triple the total points in the winner's hand after playing down the four SIMPLICITY tiles.
   b. All the points in the GAME POT
   c. All the points in the SIMPLICITY POT.
6. GO OUT
   WINNER COLLECTS:
   a. FROM EACH PLAYER — Double the total points in each player's own hand.
   b. All the points in the GAME POT.
7. PASSING
   a. DURING THE PLAY OF ROUND:
   1. If the player has not yet come down — No payment.
   2. After the player has come down — 10 points to GAME POT.
   b. WHEN PASS ENDS ROUND:
   1. PLAYER WHO PASSED — 50 points to SIMPLICITY POT.
   2. WINNER COLLECTS — From each player; the total points in each player's own hand when the game ended.

NOTE: Uncollected points in the GAME POT or SIMPLICITY POT continue to accumulate round after round until collected by a winner.

I claim:

1. A board game comprising in combination:

a game board having a series of areas provided with indicia therein keyable with identical indicia provided on a set of playing tiles, additional areas designated for the positioning therein of pre-valued elements, and a designated starting area having indicia therein keyable with like indicia carried by selected ones of said playing tiles;

a set of playing tiles subdivided into a series of sub-sets equal in number to the number of areas in said series of areas on the game board, each of said sub-sets comprising a plurality of playing tiles provided with identical indicia thereon, the indicia on the tiles of the respective sub-sets being identical to the indicia in a different one of the areas of said series of areas of the game board;

a set of three dice, a first of said dice carrying non-numerical indicia on each of the faces thereof, a second of said dice carrying a different even-numbered numeral on each of the faces thereof, and the third of said dice carrying different odd-numbered numeral on each of the faces thereof, said second and third dice each being color coded a different color, and said first dice having at least one of the faces thereof, color coded to correspond with the color on a different one of said second and third dice;

a set of pre-valued elements; and at least two playing tiles carrying indicia thereon identical to the indicia carried by the starting area of said game board.

2. A board game according to claim 1, wherein each of the areas of said series of areas on said game board is provided with a different numerical integer of from 1 to 12 and at least one symbol selected from the four symbols carried by the cards of a deck of playing cards, i.e., clubs, diamonds, hearts and spades.

3. A board game according to claim 1, wherein the designated starting area on said game board is quadrilateral and a different one of each of the four symbols carried by the cards of a deck of playing cards, i.e., clubs, diamonds, hearts and spades, is carried therewithin adjacent respective ones of the side thereof.

4. A board game according to claim 1, wherein the integers on said second dice run consecutively from 2 to 12 and the integers on said third dice run consecutively from 1 to 11.

5. A board game according to claim 2, wherein each of said sub-sets comprises six playing tiles.

6. A board game according to claim 1, wherein said set of pre-valued elements comprise a set of coin-like elements each of which carries a pre-selected assigned point value.

7. A board game according to claim 1, wherein said game board is provided with a series of eight adjacently arranged spaces which are consecutively numbered from 1 to 8, selected ones of said spaces carrying indicia specifying a game ending play.

8. A board game according to claim 1, including a plurality of elongated tile-holder members adapted to support a plurality of playing tiles in side-by-side relation and in such manner that the indicia on all of such playing tiles are simultaneously displayed.

* * * * *